US005145413A

United States Patent [19]

Okamoto et al.

[11] Patent Number: 5,145,413

[45] Date of Patent: Sep. 8, 1992

[54] NOISE SUPPRESSING CONNECTOR

[75] Inventors: Hiroyuki Okamoto; Kunio Hoshino; Masakazu Umemura; Sayoko Kitahara, all of Shizuoka, Japan

[73] Assignee: Yazaki Corporation, Japan

[21] Appl. No.: 730,741

[22] Filed: Jul. 16, 1991

[30] Foreign Application Priority Data

Jul. 24, 1990 [JP] Japan ..... 2-193820
May 23, 1991 [JP] Japan ..... 3-118562

[51] Int. Cl.[5] ..... H01R 13/66

[52] U.S. Cl. ..... 439/620; 333/182; 439/736

[58] Field of Search ..... 439/620, 608, 607, 610, 439/609; 333/181-185

[56] References Cited

U.S. PATENT DOCUMENTS

| | | | |
|---|---|---|---|
| 4,314,213 | 2/1982 | Wakino | 333/185 |
| 4,660,907 | 4/1987 | Belter | 439/620 |
| 4,699,590 | 10/1987 | Farrar et al. | 439/620 |
| 4,726,790 | 2/1988 | Hadjis | 439/620 |
| 4,729,752 | 3/1988 | Dawson, Jr. et al. | 439/620 |
| 4,820,202 | 4/1989 | Edwards et al. | 439/620 |
| 4,929,196 | 5/1990 | Ponn et al. | 333/185 |
| 4,992,061 | 2/1991 | Brush, Jr. et al. | 439/620 |

*Primary Examiner*—David L. Pirlot

*Attorney, Agent, or Firm*—Nikaido, Marmelstein, Murray & Oram

[57] ABSTRACT

The invention improves assembly efficiency by allowing an increased amount of assembly work to be automated. The noise suppressing connector incorporates a capacitor array having a plurality of individual electrodes arranged on the surface of a dielectric material and an earth electrode at the back; a plurality of lead terminals each having input/output portions and an intermediate portion, the intermediate portions being placed in contact with individual electrodes, said intermediate portions and the capacitor array being molded together within an insulating resin; and a metal housing connected with the earth electrode and adapted to accommodate and hold the molded resin block. An earth plate may be interposed between the earth electrode and the metal housing. Solder loading grooves may be provided to the metal housing at positions facing the earth electrode or earth plate to connect the earth electrode or earth plate with the metal housing by solder. This ground connection may also be provided by using earth terminals with a bent portion, which are arranged parallel with the lead terminals to hold the capacitor array between the bent portions and the lead terminals so that the bent portions contact the earth electrode, with the earth terminals soldered to the metal housing.

5 Claims, 9 Drawing Sheets

NOISE SUPPRESSING CONNECTOR

BACKGROUND OF THE INVENTION

1. Field of the Invention

The present invention relates to a noise suppressing connector that enables automatic assembly.

2. Description of the Prior Art

FIG. 13 is a perspective exploded view of a conventional noise suppressing connector 46 described in the Japanese Patent Preliminary Publication No. Showa 55-95281.

In the figure, denoted 47 is a connector housing of synthetic resin with openings 48 at both ends. A plurality of pin terminals 50 are erected in parallel to one another erected on a partition wall 49. Designated 51 is a metallic conductive plate which has an insertion opening 52 for the pin terminals 50 and also has a pair of earth terminals 53 projecting therefrom. Reference numeral 54 represents a platelike capacitor which consists of a dielectric plate 55 with cylindrical internal electrodes 56 arranged in parallel thereon. A shield case 57 has a bottom wall 58 which has an insertion opening 59 and notch portions 60 for the earth terminals 53.

An external electrode (not shown) of the capacitor 54 is soldered to the conductive plate 51, and the pin terminals 50 are inserted into the internal electrodes 56. The conductive plate 51 is installed in the connector housing 47 and then the inner electrodes 56 and the pin terminals 50 are soldered together. The shield case 57 is placed over the outer wall surface of the connector housing 47. The earth terminals 53 are soldered to the notch portions 60 of the shield case 57.

In the conventional construction shown above, however, the processes of soldering the dielectric plate 55 of the capacitor 54 to the conductive plate 51, inserting the pin terminals 50 into the inner electrodes 56 and soldering them, must all be carried out manually and the resulting productivity is very bad.

The inventor of this invention proposed a noise suppressing connector as shown in FIGS. 14 and 15 in the Japanese Utility Model Application No. Heisei 2-39037.

The noise suppressing connector 27 in FIG. 14 has its unnecessary portions 29*a* to 29*c* of a lead frame 28 cut off along the broken lines B, C. The lead frame 28 is formed with a plurality of input/output lead terminals 30, 31 on each side and with a strip of common earth terminal 32 at the center. A chip capacitor 35 consisting of input/output electrodes 36, 37 and an earth electrode 38 is mounted on the lead frame 28 so that the input/output electrodes 36, 37 connect to the base portions 33, 34 of the lead frame 28 and that the earth electrode 38 connects to the common earth terminal 32. These connections are enclosed with a resin mold 39 to form a capacitor connection terminal 40. The capacitor connection terminal 40 is installed in a synthetic resin housing 41, as shown in FIG. 15, and the housing 41 is in turn mounted inside the metallic shield case 42 with the ends 32*a*, 32*b* of the common earth terminal 32 soldered to the bracket walls 43, 44 at portions 45.

This construction permitted automated assembly, improving yields.

SUMMARY OF THE INVENTION

An object of the invention is to provide a noise suppressing connector which enables a further automation of the assembly work and which can also be applied to a power supply circuit that carries a large current.

To achieve the above objective, a noise suppressing connector according to this invention comprises: a capacitor array having a plurality of individual electrodes arranged on the surface of a dielectric material and an earth electrode attached to the back of the dielectric material; a plurality of lead terminals each having output and input portions and also an intermediate portion, said intermediate portions being in contact with the individual electrodes of the capacitor array, said intermediate portion and the capacitor array being molded together with an insulating resin; and a metal housing connected to the earth electrode of the capacitor array and adapted to accommodate and hold said molded portion.

The process of mounting and connecting the lead terminals to the capacitor array and molding them can be performed efficiently by using an automated machine. The lead terminals have their intermediate portions in contact with individual electrodes of the capacitor array, rather than separating the input side from the output side as in the conventional apparatus, so that a large current can be carried by this connector. Furthermore, the passages running from each lead terminal via capacitor array to the metallic housing can be set short and equal in length, thus stabilizing the filter characteristic.

DETAILED DESCRIPTION OF PREFERRED EMBODIMENT

Figure 1:
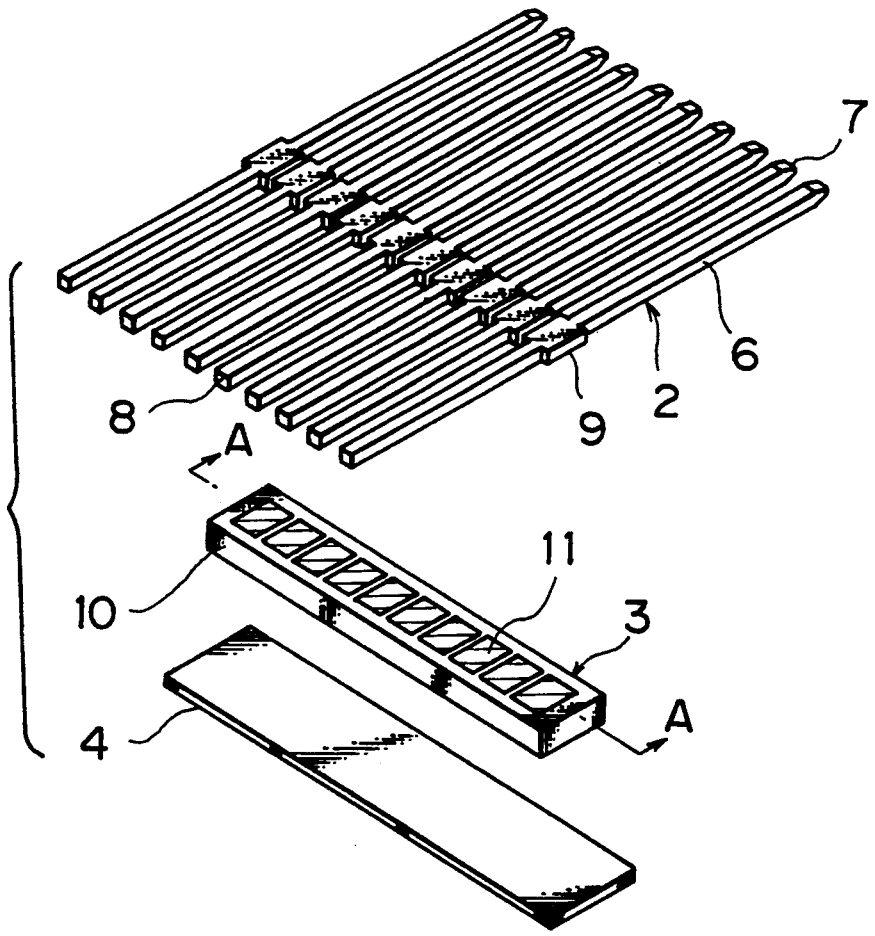
FIG. 1 is an exploded perspective view of a filter block as one embodiment of this invention, showing the process of manufacturing thereof.
Figure 2:
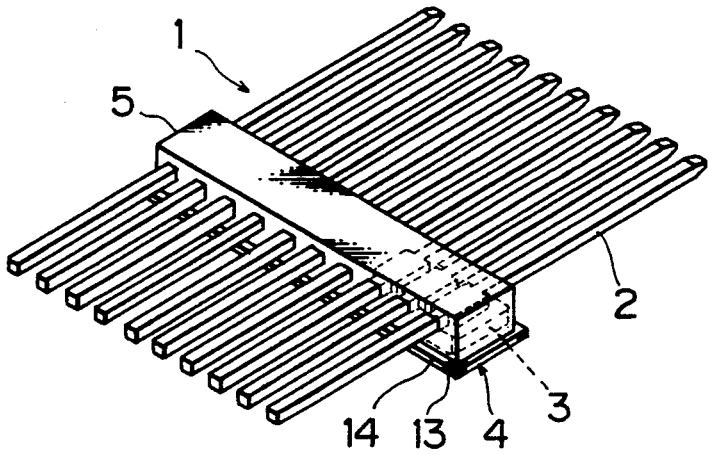
FIG. 2 is a perspective view of the filter block of FIG. 1 assembled together.

FIGS. 1 and 2 shows the process of making one embodiment of a filter block, which is an internal structure of a noise suppressing connector of this invention.

The filter block 1 consists of a plurality of lead terminals 2 arranged in parallel, a capacitor array 3 for the lead terminals 2, and an earth metal plate 4, all stacked one upon the other and molded together with an insulating synthetic resin 5.

Figure 3:
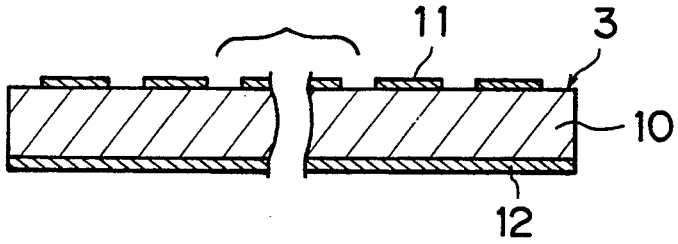
FIG. 3 is a cross section taken along the line A—A of FIG. 1.
Figure 4:
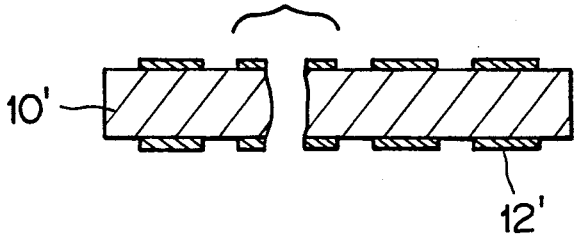
FIG. 4 is a cross section of a variation of the filter block.

In each of the lead terminals 2, a front end of a metal tab 6, which is rectangular in cross section, is used as an input portion 7 a rear end as an output portion 8, and an intermediate portion as a flat contact portion 9. The capacitor array 3, as shown in FIG. 3 which is a cross section taken along the line A—A of FIG. 1, consists of a dielectric plate 10 of a rectangular pillar, a plurality of individual electrodes 11 in parallel arranged on the upper surface of the dielectric plate 10 and connected with the contact portion 9 of the lead terminal 2, and a common earth electrode 12 attached to the entire undersurface of the dielectric plate 10. As shown in FIG. 4, the individual earth electrodes 12' may be formed on the bottom surface of the dielectric plate 10'.

The contact portions 9 of the lead terminals 2 are placed in surface contact with the individual electrodes 11 and soldered together. The rectangular earth metal plate 4 is also put in surface contact with the earth electrode 12 and then soldered together. The capacitor array 3 is molded enclosed with the insulating resin 5. The earth metal plate 4 is exposed at the undersurface 13 and the side surfaces 14, which are put in contact with a metal housing 15 described later.

Figure 5:
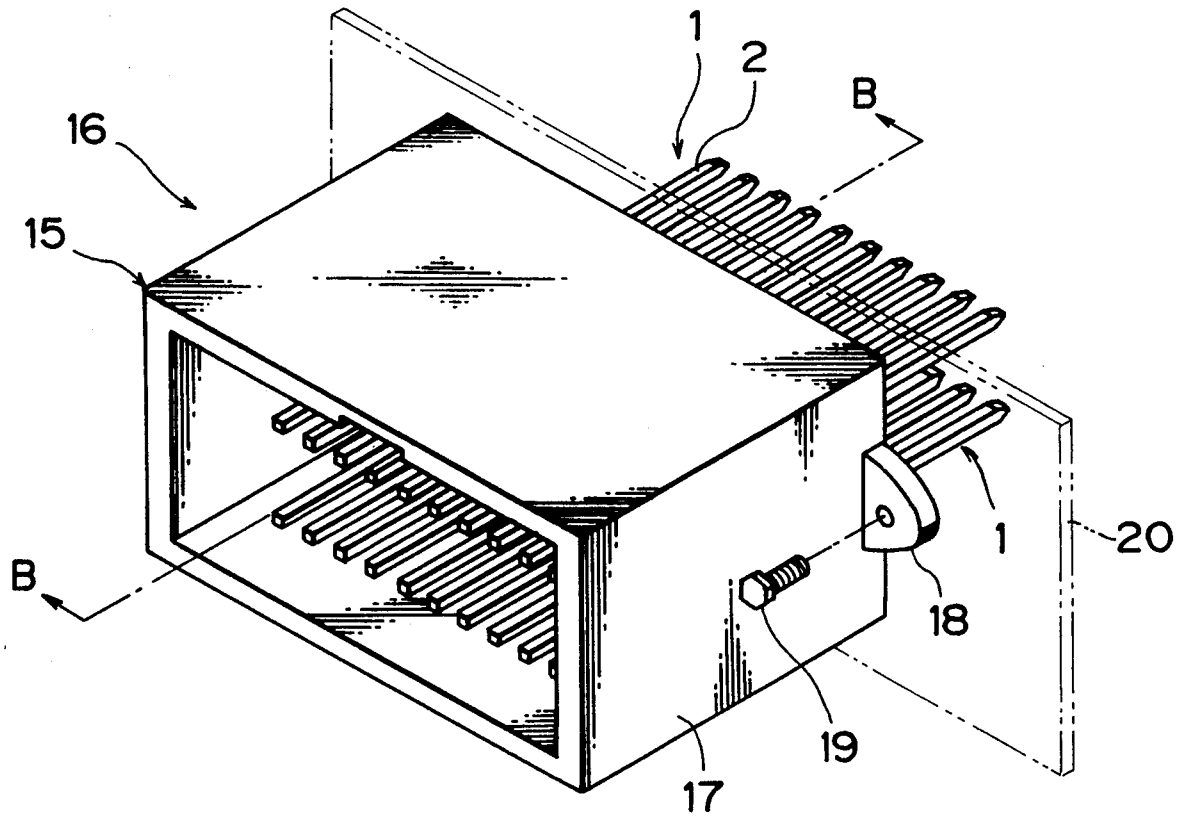
FIG. 5 is an external perspective view of a noise suppressing connector according to this invention.

FIG. 5 shows a noise suppressing connector 16 whose conductive metal housing 15 contains two tiers of the above-mentioned capacitor-connected terminals 1. The metal housing 15 has earth brackets 18 projecting from its side walls 17 through which screws 19 are inserted to fix the housing 15 to a printed circuit card 20.

Figure 6:
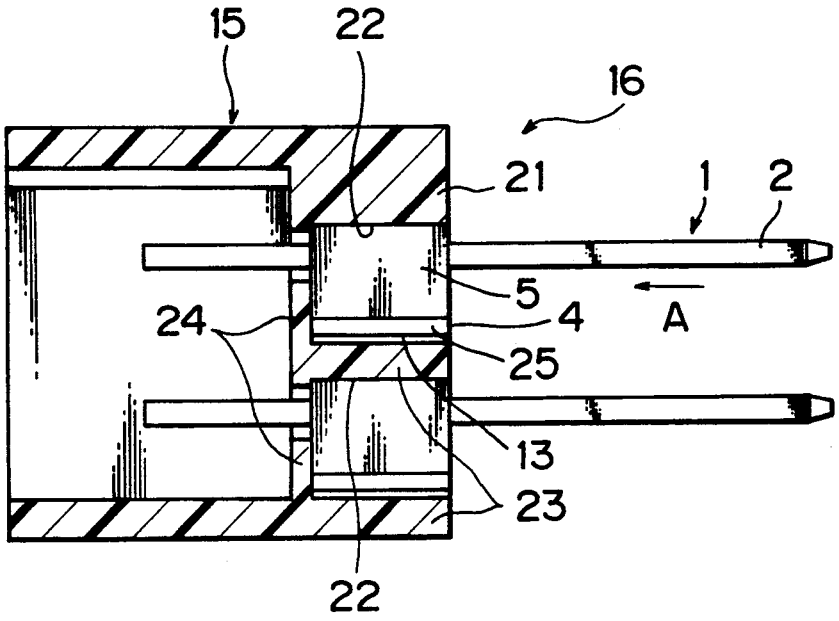
FIG. 6 is a cross section taken along the line B—B of FIG. 5.

FIG. 6 is a cross section taken along the line B—B of FIG. 5. A front wall 21 of the metal housing 15 is formed with two vertically spaced engagement holes 22 that accommodate the resin molded portions 5 of the capacitor-connected terminals 1. On the rear part of bottom walls 23 of the engagement holes 22 are erected stopper plate 24, against which the molded portions 5 are inserted into the engagement holes 22 in the direction of arrow A. The undersurface 13 of the earth metal plate 4 is placed in surface contact with and soldered to the bottom wall 23 as shown at 25. A pressure connecting means may be used instead of the soldered connection 25. Rather than using the earth metal plate 4, it is also possible to bring the earth electrode 12 of the capacitor array 3 into direct contact with the bottom wall 23 of the metal housing 15.

As mentioned above, the assembly of the filter block 1 can be done by stacking the lead terminals 2, the capacitor array 3 and the earth metal plate 4 and molding them together by the resin mold 5. This assembly can be performed efficiently using an automated machine not shown. The work of inserting the filter block 1 into the engagement hole 22 in the metal housing 15 can also be done using the automated machine. Since the lead terminals 2, the capacitor array 3, the earth metal plate 4 and the metal housing 15 are in planar contact with each other, the contact resistance is small, allowing noise to be grounded through the metal housing 15 without a loss.

Further, since the ground connection distances from each lead terminal 2 to the metal housing 15 are small and equal, there are no variations in the filter characteristic among the lead terminals 2. The connector of this invention can carry a source current of up to several amperes that cannot be passed through the conventional noise suppressing connector (the allowable current of the chip capacitor is about 300 mA).

Figure 7:
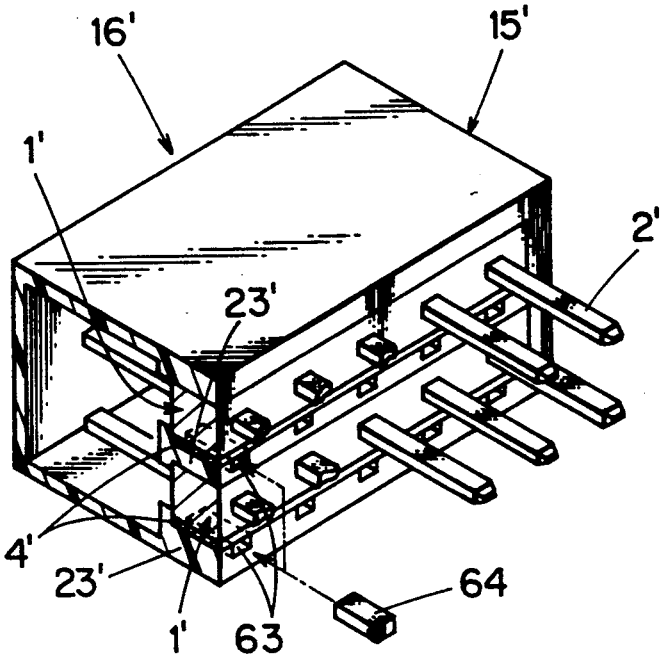
FIG. 7 is a partially cutaway perspective view of another variation of the noise suppressing connector.

FIG. 7 shows another example of a noise suppressing connector 16'. This connector has solder loading grooves 63, which are U-shaped in cross section and formed in the bottom wall 23' of the metal housing 15' so that they face the earth metal plate 4' of the filter block 1'. This structure, when applied to the noise suppressing connector 16, facilitates the soldering between the earth metal plate 4 of the filter block 1 and the metal housing 15.

The solder loading grooves 63 are each located at a position facing the corresponding lead terminal 2' and loaded with a square pillar of solder pellet 64 or a cream solder not shown. The connector assembly loaded with the solder is heated to melt the solder to connect the earth metal plate 4' and the metal housing 15'. The supply and heating of the solder 64 can easily be done with an automated equipment not shown, ensuring highly reliable soldered connections.

Figure 8:
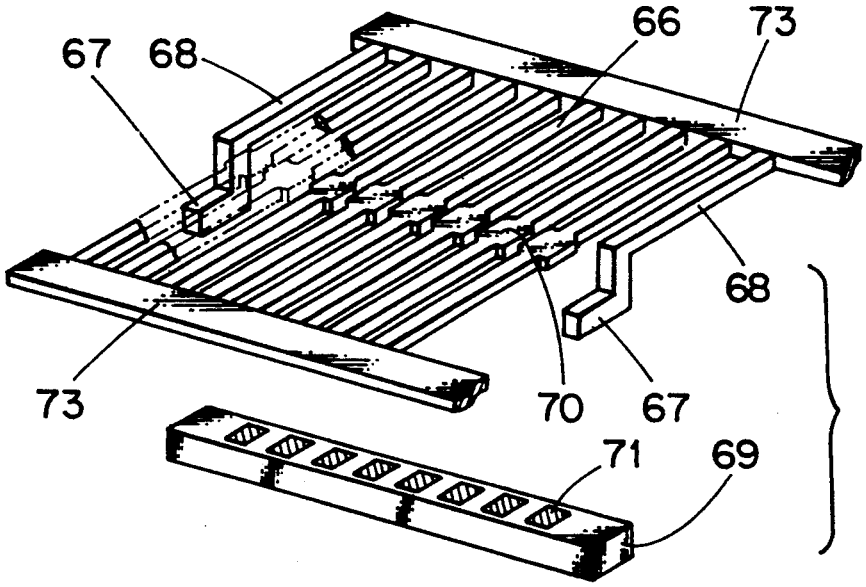
FIG. 8 is an exploded perspective view showing the process of manufacturing another embodiment of the filter block.
Figure 9:
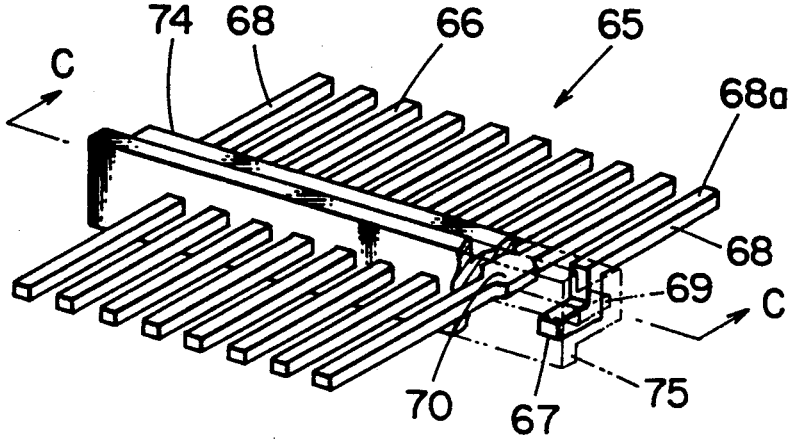
FIG. 9 is a perspective view of the assembled filter block.

FIGS. 8 and 9 show the process of assembling other embodiments of the filter block.

The filter block 65 consists of a plurality of lead terminals 66 arranged in parallel; a pair of earth terminals 68 located on each side of the group of lead terminals 66, each of which has a crank-shaped bent portion 67; and a capacitor array 69 held between the lead terminals 66 and the bent portions 67 of the earth terminals 68.

Figure 10:
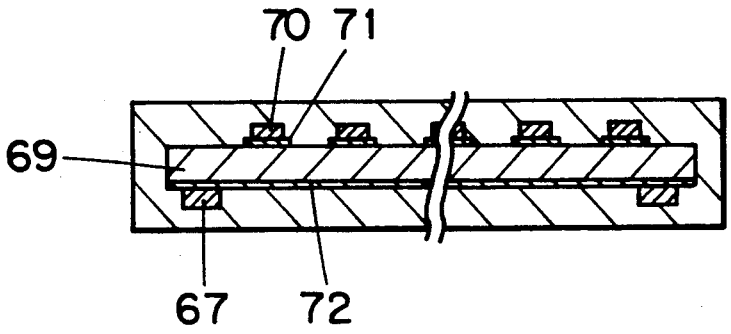
FIG. 10 is a cross section taken along the line C—C of FIG. 9.

The bent portion 67 is located at a position corresponding to the flat contact portion 70 of the lead terminal 66. As shown in FIG. 10, a cross section taken along the line C—C of FIG. 9, the flat contact portions 70 are in contact with the individual electrodes 71 on the upper surface of the capacitor array 69, and the bent portions 67 are in contact with the earth electrode 72 at the back of the capacitor array 69. In FIG. 8, denoted 73 is a terminal link bar used only during the manufacturing process and is cut and removed after the capacitor array 69 are molded enclosed with the insulating resin 74, as shown in FIG. 9. This molded portion 74 is also formed integral with engagement flanges 75 at the rear edge thereof.

Figure 11:
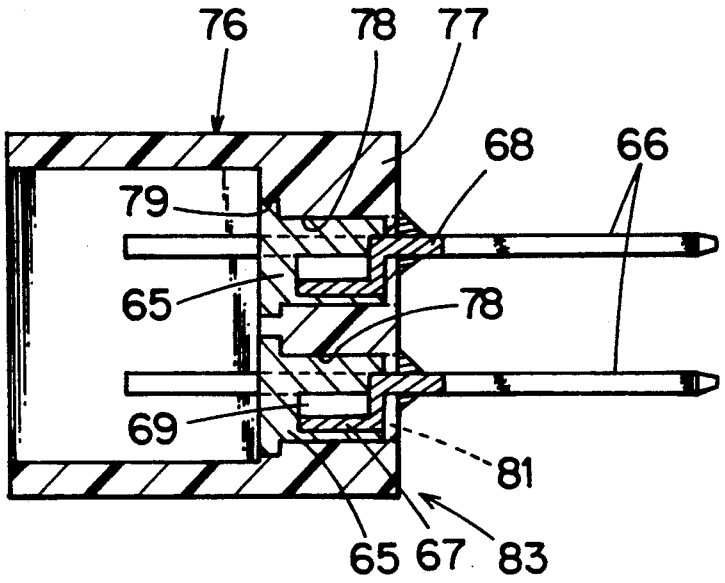
FIG. 11 is a vertical cross section of a noise suppressing connector with the filter blocks assembled into the metallic housing.
Figure 12:
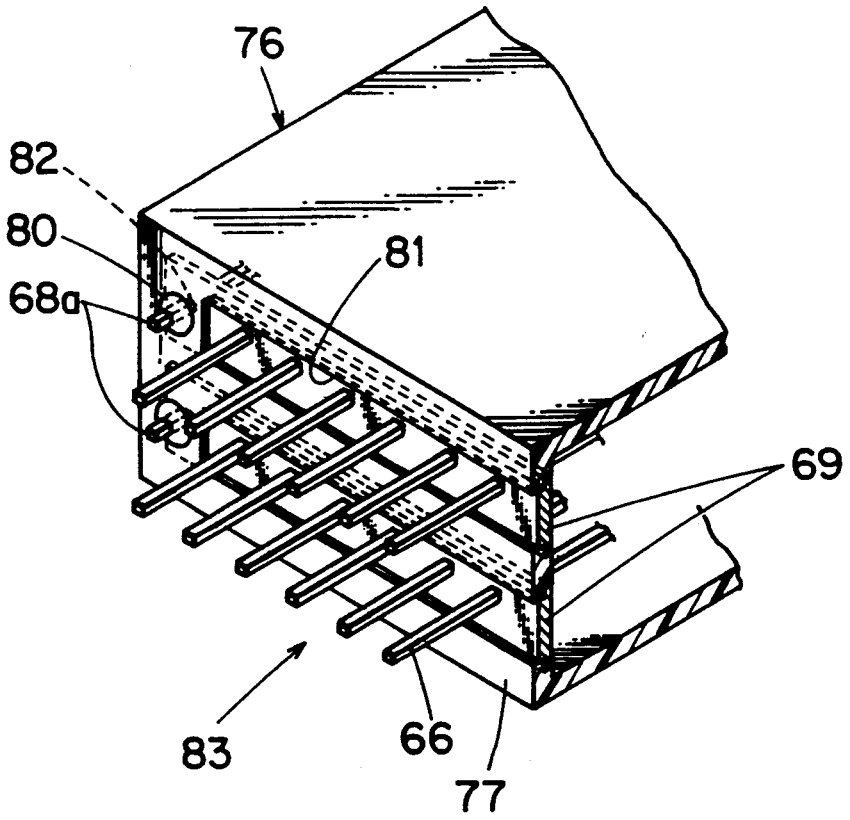
FIG. 12 is a partially cutaway perspective view of the noise suppressing connector.
Figure 13:
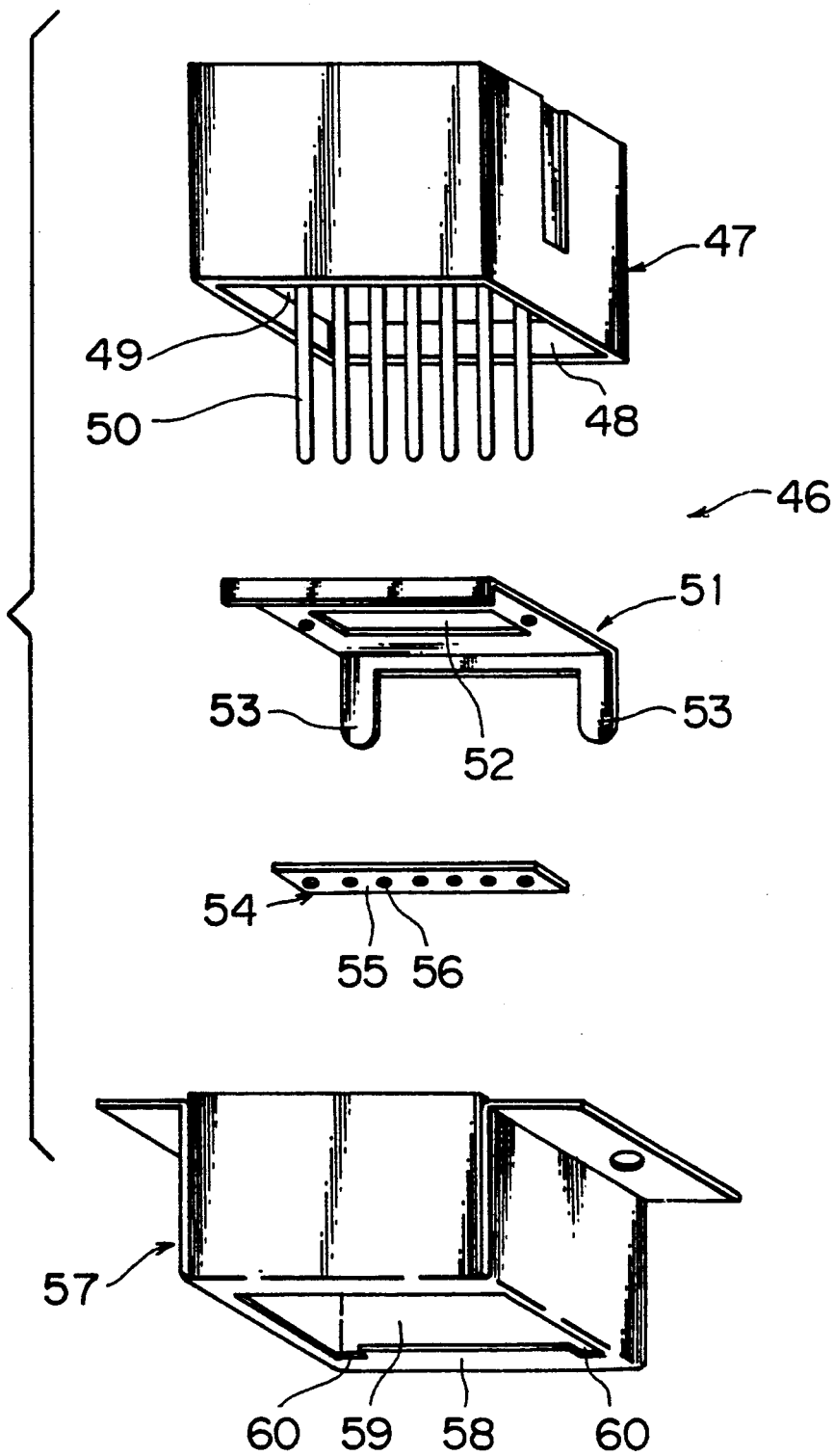
FIG. 13 PRIOR ART
FIG. 13 is an exploded perspective view of a conventional connector.
Figure 14:
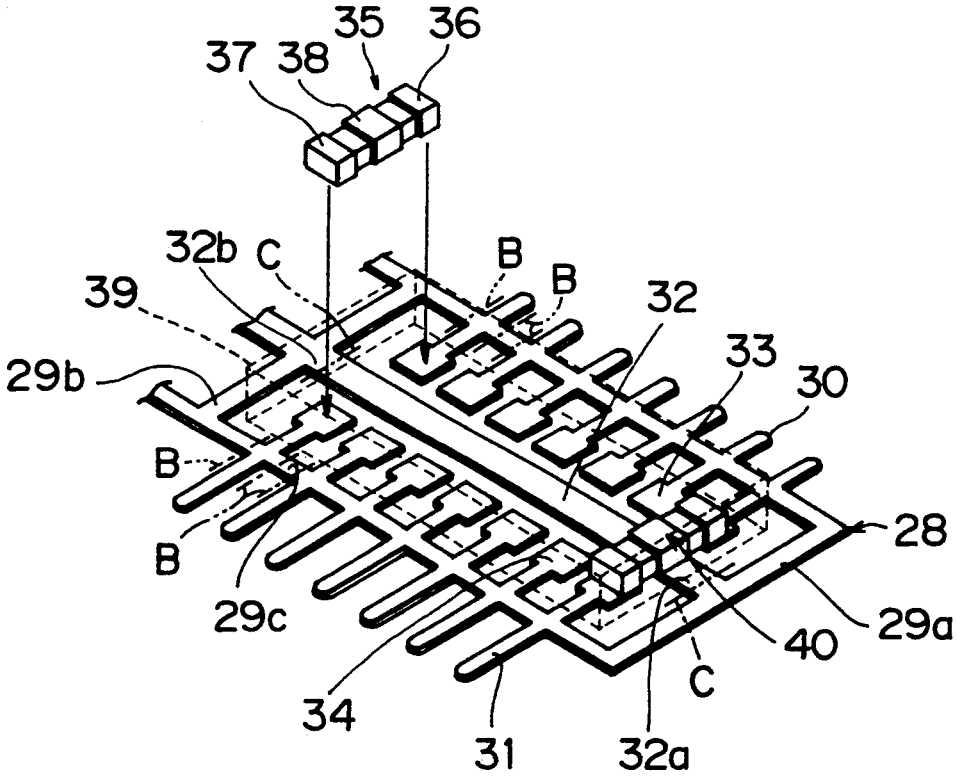
FIG. 14 PRIOR ART
FIG. 14 is a perspective view showing a filter block of the conventional connector.
Figure 15:
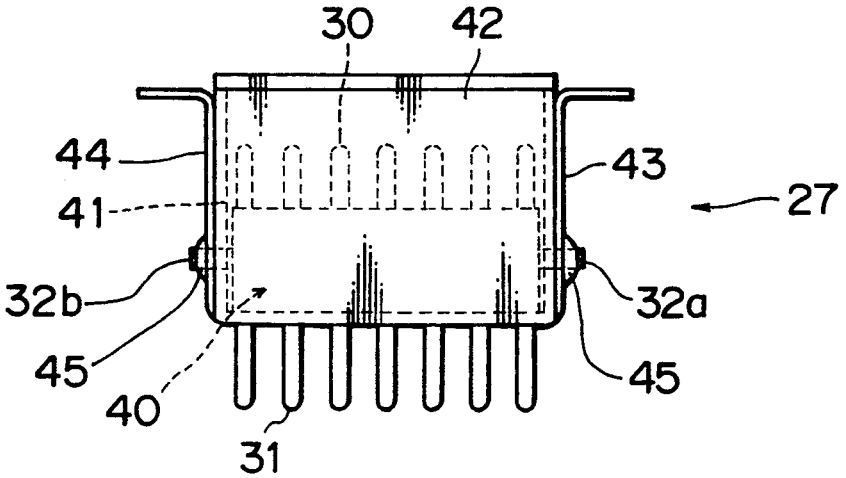
FIG. 15 PRIOR ART
FIG. 15 is a plan view of the conventional noise suppressing connector using the filter block of FIG. 14.

FIG. 11 shows the filter blocks 65 assembled into the upper and lower engagement holes 78 formed in the front wall 77 of the metal housing 76. The filter blocks 65 are inserted from within the metal housing 76 until the flanges 75 engage with end grooves 79 of the engagement holes 78. Further, as shown in FIG. 12, the front ends 68*a* of the earth terminals 68 are connected to the front wall 77 of the metal housing 76 with a solder 80.

Now, from an opening 81 of the engagement hole 78 in the metal housing 76 project only the lead terminals 66. The earth terminals 68 project from terminal holes 82 formed in the side portion of the front wall 77, with their front ends 68*a* soldered there. This solder connection can be formed by a commonly used dip solder method, which provides highly reliable, inexpensive connections.

The advantages of this invention may be summarized as follows. The assembly process can easily be automated for improved productivity. The noise suppressing connector of this invention can be applied to a power source circuit that carries a large current. Further, since the passages from each lead terminal to the metal housing via the capacitor array can be set short and equal in length, a stable filter characteristic can be obtained.

What is claimed is:

1. A noise suppressing connector comprising:

a capacitor array having a plurality of individual electrodes arranged on the surface of a dielectric material and an earth electrode attached to the back of the dielectric material;

a plurality of lead terminals each having output and input portions and also an intermediate portion, the intermediate portions being in electrical contact with the individual electrodes of said capacitor array;

a molded insulating resin block enclosing said plurality of lead terminals at the intermediate portions in electrical contact with the individual electrodes of said capacitor array, the earth electrode being positioned outside of said molded insulating resin block; and a metal housing connected to the earth electrode of said capacitor array and adapted to accommodate and hold said molded insulating resin block.

2. A noise suppressing connector as claimed in claim 1 wherein solder loading grooves are provided in an inner wall of said metal housing at positions facing the earth electrode or earth plate so that the earth electrode or earth plate and said metal housing are connected by the solder loaded in the solder loading grooves.

3. A noise suppressing connector as claimed in claim 1, wherein earth terminals having a bent portion are arranged parallel with said plurality of lead terminals to hold said capacitor array between the bent portions and said plurality of lead terminals such that the earth electrode of said capacitor array is in contact with the bent portions, and the earth terminals are soldered to said metal housing.

4. A noise suppressing connector as claimed in claim 1, wherein an earth plate is interposed between said earth electrode and the metal housing.

5. A noise suppressing connector as claimed in claim 4, wherein solder loading grooves are provided in an inner wall of said metal housing at positions facing said earth electrode or earth plate so that the earth electrodes or earth plate and the metal housing are connected by the solder loaded in the solder loading grooves.

* * * * *